US009498956B2

(12) United States Patent
Kato et al.

(10) Patent No.: US 9,498,956 B2
(45) Date of Patent: Nov. 22, 2016

(54) LIQUID EJECTION HEAD, METHOD FOR CLEANING THE HEAD, RECORDING APPARATUS PROVIDED WITH THE HEAD

(71) Applicant: CANON KABUSHIKI KAISHA, Tokyo (JP)

(72) Inventors: Maki Kato, Fuchu (JP); Takahiro Matsui, Yokohama (JP); Ichiro Saito, Yokohama (JP); Yuzuru Ishida, Yokohama (JP); Kenji Takahashi, Yokohama (JP); Norihiro Yoshinari, Kawasaki (JP); Yoshinori Misumi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/717,885

(22) Filed: May 20, 2015

(65) Prior Publication Data

US 2015/0336385 A1 Nov. 26, 2015

(30) Foreign Application Priority Data

May 22, 2014 (JP) ..... 2014-105925

(51) Int. Cl.

| | |
|---|---|
| ***B41J 2/165*** | (2006.01) |
| ***B41J 2/14*** | (2006.01) |
| ***B41J 2/045*** | (2006.01) |

(52) U.S. Cl.

CPC ..... *B41J 2/16517* (2013.01); *B41J 2/0451* (2013.01); *B41J 2/0458* (2013.01); *B41J 2/04508* (2013.01); *B41J 2/04555* (2013.01); *B41J 2/14072* (2013.01); *B41J 2/14153* (2013.01); *B41J 2/16508* (2013.01); *B41J 2/16523* (2013.01); *B41J 2/16532* (2013.01); *B41J 2002/14354* (2013.01); *B41J 2002/16564* (2013.01)

(58) Field of Classification Search

CPC .. B41J 2/165; B41J 2/16517; B41J 2/14072; B41J 2/0451; B41J 2/04508

See application file for complete search history.

(56) References Cited

U.S. PATENT DOCUMENTS

| | | | | |
|---|---|---|---|---|
| 8,123,330 | B2 * | 2/2012 | Sakai | B41J 2/14072 347/22 |
| 2007/0076025 | A1 * | 4/2007 | Nagashima | B41J 2/165 347/7 |
| 2009/0251126 | A1 * | 10/2009 | Ishino | G01N 33/2852 324/71.1 |

FOREIGN PATENT DOCUMENTS

| | | | |
|---|---|---|---|
| JP | 2008-105364 | A | 5/2008 |

* cited by examiner

*Primary Examiner* — Sarah Al Hashimi

(74) *Attorney, Agent, or Firm* — Canon U.S.A. Inc., IP Division

(57) ABSTRACT

Cleaning under appropriate cleaning conditions is performed by disposing an electrode pair for measuring conductivity in the same liquid chamber as that of a material layer (i.e., an upper electrode) of a surface of a thermal action portion to be eluted, and measuring conductivity of a liquid using the electrode pair before kogation is removed.

7 Claims, 7 Drawing Sheets

LIQUID EJECTION HEAD, METHOD FOR CLEANING THE HEAD, RECORDING APPARATUS PROVIDED WITH THE HEAD

BACKGROUND OF THE INVENTION

Field of the Invention

The present invention relates to a liquid ejection head that ejects ink by a liquid ejecting method and records on a recording medium, and a method for cleaning the head. The invention relates also to a recording apparatus provided with the head.

Description of the Related Art

In a liquid ejecting method (i.e., an inkjet recording method), a liquid (e.g., ink) is ejected from ejection ports provided in a liquid ejection head, and is caused to adhere for recording on a recording material, such as a paper sheet. The inkjet recording method in which the liquid is ejected by foaming of the liquid produced by thermal energy generated by electrothermal converting elements enables high quality and high speed printing.

Typically, a liquid ejection head of this kind has a plurality of ejection ports, a flow path communicating with the ejection ports, and a plurality of electrothermal converting elements that generate thermal energy to eject ink. Each of the electrothermal converting elements is constituted by a heat generating resistive element and an electrode that supplies the heat generating resistive element with electric power. The electrothermal converting element is covered with an insulating lower protective layer, such as silicon nitride, and is thus insulated from ink.

A heat generating portion of the electrothermal converting element is exposed to high temperatures and, at the same time, is complexly subject to cavitation impacts caused by foaming and contraction of a liquid, and chemical actions caused by ink. To protect the heat generating resistive element from the cavitation impacts and chemical actions caused by ink, an upper protective layer is provided in the heating unit. A temperature of a surface of the upper protective layer rises to as high as about 700 degrees centigrade and touches the ink. Therefore, the surface needs to be excellent in film characteristics, such as heat resistance, mechanical property, chemical stability, and alkali resistance.

A coloring material, an additive, and other materials included in the ink are separated with a molecular level when heated at high temperatures, and these materials change to hardly soluble materials called "kogation." When the kogation is physically adsorbed onto the upper protective layer, the following problems occur: heat is conducted unevenly from the heat generating resistive element to the ink, and, therefore, ejection speed of the ink is lowered, foaming becomes unstable, and more energy is required for the ejection.

Then, Japanese Patent Laid-Open No. 2008-105364 discloses a technique to remove kogation by forming a surface of an upper protective layer using a material elutable by an electrochemical reaction, such as iridium and ruthenium.

SUMMARY OF THE INVENTION

A liquid ejection head according to an aspect of the present invention is a liquid ejection head, which includes: liquid ejection ports; a liquid chamber communicating with the liquid ejection ports; an electrothermal converting portion disposed in the liquid chamber; an insulating protective layer configured to insulate the electrothermal converting portion from a liquid in the liquid chamber; an upper electrode configured to cover at least a portion heated by the electrothermal converting portion of the protective layer, and made of a material eluted by an electrochemical reaction with the liquid; and a counter electrode configured to face the upper electrode via the liquid and supply the upper electrode with electric power to cause an electrochemical reaction with the liquid, wherein the liquid ejection head includes a conductivity measuring unit of the liquid provided with an electrode pair that touches the liquid in the liquid chamber.

A method for cleaning a liquid ejection head according to another aspect of the present invention is a method for cleaning a liquid ejection head which includes liquid ejection ports, a liquid chamber communicating with the liquid ejection ports, an electrothermal converting portion disposed in the liquid chamber, an insulating protective layer configured to insulate the electrothermal converting portion from a liquid in the liquid chamber, an upper electrode configured to cover at least a heat generating portion heated by the electrothermal converting portion of the protective layer, and made of a material eluted by an electrochemical reaction with the liquid, and a counter electrode configured to face the upper electrode via the liquid and supply the upper electrode with electric power to cause the electrochemical reaction, in which the method includes a cleaning operation to simultaneously cause to elute by an electrochemical reaction of the upper electrode and remove impurities produced by heat of the liquid and had adhered to a surface of the upper electrode that surrounds the heat generating portion, the method including: before the cleaning operation, measuring conductivity of the liquid; and in accordance with the measured conductivity of the liquid, setting cleaning conditions in the cleaning operation.

A recording apparatus according to an another aspect of the present invention is a recording apparatus that performs recording using a liquid ejection head, comprising: liquid ejection ports; a liquid chamber communicating with the liquid ejection ports; an electrothermal converting portion disposed in the liquid chamber; an insulating protective layer configured to insulate the electrothermal converting portion from a liquid in the liquid chamber; an upper electrode configured to cover at least a heat generating portion heated by the electrothermal converting portion of the protective layer, and made of a material eluted by an electrochemical reaction with the liquid; and a counter electrode configured to face the upper electrode via the liquid and supply the upper electrode with electric power to cause the electrochemical reaction, wherein, the recording apparatus having a cleaning unit that removes impurities adhering to a surface of the upper electrode produced by heat of the liquid by applying a voltage between the upper electrode and the counter electrode as the upper electrode is caused to elute further includes a unit for applying a voltage to an electrode pair that touches a liquid in the liquid chamber, and detecting conductivity of the liquid from the current value, and the cleaning unit sets a voltage value and/or application time applied between the upper electrode and the counter electrode in accordance with the detected conductivity.

Further features of the present invention will become apparent from the following description of exemplary embodiments with reference to the attached drawings.

DESCRIPTION OF THE EMBODIMENTS

In the method for cleaning to remove kogation disclosed in Japanese Patent Laid-Open No. 2008-105364, a positive potential is applied to a material elutable in a liquid by an electrochemical reaction to cause the material to be eluted into the liquid and, at the same time, to remove kogation. A material layer needs to have equal to or greater than a certain thickness to protect the heat generating resistive element from cavitation impacts when the ink is ejected and chemical actions by the ink. An elution amount of the material layer due to removal of kogation needs to be managed so that a head can be replaced when a remaining amount of the material layer due to elution of the material layer as a result of the cleaning becomes lower than a predetermined value.

Generally, the elution amount of the material layer depends on electricity quantity (i.e., coulomb quantity) that passes through the material. If conductivity of the liquid is not changed, the elution amount of the material layer at a certain voltage is not changed, either. Therefore, the remaining amount of the material layer may be calculated from the number of times of removal of kogation. In a case in which the ink itself is used as a liquid for cleaning, if conductivity is changed due to, for example, color mixing of the ink from an adjoining nozzle, the elution amount of the material layer is changed at the same voltage. Further, conductivity may vary due to manufacture variations caused by different lot numbers of ink. Other than that, conductivity changes due to various causes: for example, a change in conductivity caused by replacement of an ink reservoir, and a change in conductivity caused by ink deterioration after the ink is stored for a long time.

With such variation in the elution amount of the material layer caused by the change in conductivity, there is a case in which kogation is not sufficiently removed by cleaning and printing quality is not recovered, and there is a case in which excessive cleaning is required so that the head reaches its life end earlier than expected. That is, in the method for cleaning under predetermined conditions, there is a case in which the elution amount of the material layer is not sufficiently managed.

The present invention enables an elution amount of a material layer after cleaning for removal of kogation to be correctly known even if conductivity of a liquid for cleaning, especially ink, has variation. Further, the present invention provides a method for cleaning in which appropriate cleaning conditions are set even if conductivity of ink has variation.

A feature of the present invention is to determine cleaning conditions by measuring conductivity of a liquid in a liquid chamber before cleaning, and to control an elution amount of an upper electrode.

Hereinafter, the present invention will be described in detail with reference to the drawings.

1. Description of Liquid Ejection Head of Present Invention

Figure 1:
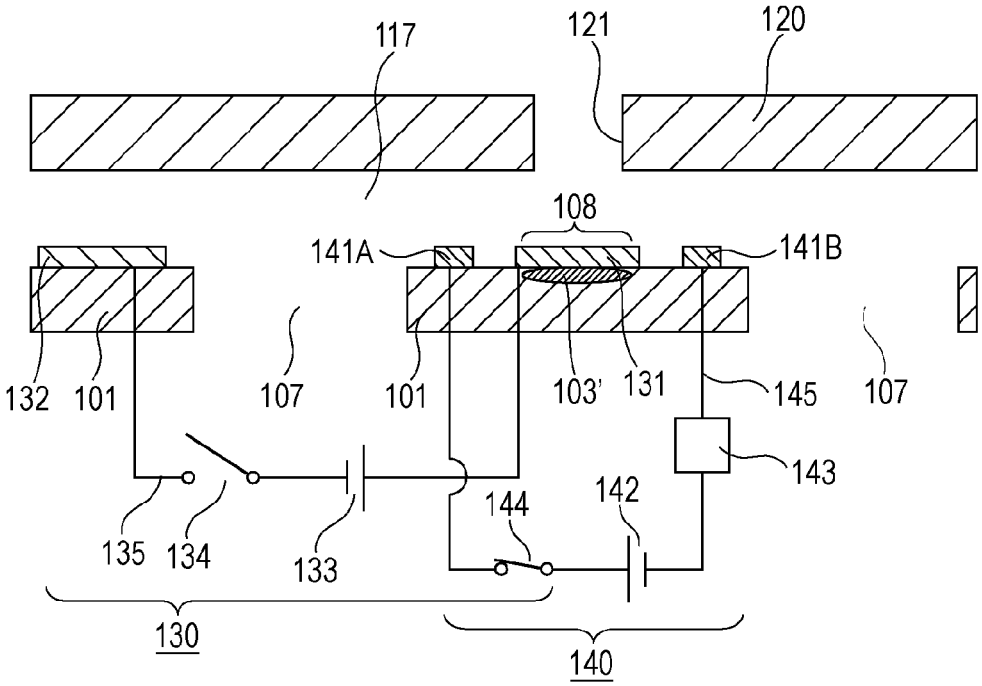
FIG. 1 is a schematic diagram illustrating a cleaning unit and a conductivity measuring unit in a liquid ejection head according to an embodiment of the present invention.

FIG. 1 is a diagram schematically illustrating a cleaning unit 130 and a conductivity measuring unit 140 in a liquid ejection head according to an embodiment of the present invention.

In a liquid ejection head substrate 100 in which a semiconductor device (not illustrated) is formed, an electrothermal converting portion 103' that is a part of a heat generating resistive element layer 103 (not illustrated) is provided. A wiring layer 104 (not illustrated), a protective layer 105 (not illustrated), and an adhesion layer 116 (not illustrated) are formed above the heat generating resistive element layer 103. The electrothermal converting portion 103' is formed by the heat generating resistive element layer 103 exposed from a certain gap provided in the electrical wiring layer 104. An upper electrode 131 is provided at a portion corresponding to the electrothermal converting portion 103' above the adhesion layer 116. A portion of the upper electrode 131 corresponding to the electrothermal converting portion 103' becomes a thermal action portion 108 that applies heat, as ejection energy, to a liquid (i.e., ink) in a liquid chamber 117. A counter electrode 132 is provided as an electrode that makes a pair with the upper electrode 131. The upper electrode 131 has a function as a protective layer that protects the electrothermal converting portion 103' from chemical and physical impacts caused by foaming of ink and a function to remove kogation during a cleaning process.

The upper electrode 131 and the counter electrode 132 are electrically connected to each other by a wiring path 135 via a power supply 133 and a switch 134, and may form an electrical closed circuit via the liquid in the liquid chamber 117. The components constituting this closed circuit are collectively referred to as a cleaning unit 130. During a recording (printing) operation, thermal energy is applied to the thermal action portion 108 a prescribed number of times. During that operation, the switch 134 of the closed circuit is opened or power supply from the power supply 133 is stopped. The cleaning unit 130 may be used also as a unit to detect ejection of the liquid. By applying a voltage that is so low that the upper electrode 131 is not eluted by the electrochemical reaction, existence of foaming in the thermal action portion 108 may be checked. After a certain amount of kogation is deposited on a surface of the upper electrode 131 that becomes the thermal action portion 108, the cleaning process (i.e., removal of kogation) is performed. Removal of kogation causes an electrochemical reaction on an interface between the upper electrode 131 and the ink by closing this circuit. This electrochemical reaction causes a surface of the upper electrode 131 to be eluted into the ink, and then kogation adhering to the surface of the upper electrode 131 is removed. A wiring layer that constitutes a part of the upper electrode 131, the counter electrode 132, and the wiring path 135 is included inside the liquid ejection head. The switch 134 and the power supply 133 are included outside the liquid ejection head. The switch 134 may be included inside the liquid ejection head in some cases. A cleaning unit located inside the liquid ejection head may be referred to as an internal cleaning unit and a cleaning unit located outside the liquid ejection head may be referred to as an external cleaning unit.

In the present embodiment, an electrode pair 141A and 141B for measuring conductivity of the liquid is disposed in the liquid ejection head substrate 100. The electrode pair 141A and 141B is disposed in the same liquid chamber 117 as that of the upper electrode 131. The electrodes of the electrode pair 141A and 141B are electrically connected to each other by the wiring path 145 that connects the power supply 142 that applies a voltage for conductivity measurement, a detection apparatus 143 that detects a current flowing inside the circuit, and passes through the switch 144, and may form an electrical closed circuit via the liquid in the liquid chamber 117. Components that may constitute this closed circuit may collectively be referred to as a conductivity measuring unit 140. A part of electrode pair 141A and 141B and the wiring path 145 are included in the liquid ejection head, and the power supply 142, the detection apparatus 143, and the switch 144 are included as external circuits. The switch 144 may be included inside the liquid ejection head in some cases. The conductivity measuring unit included inside the liquid ejection head may be referred to as an internal conductivity measuring unit. The conductivity measuring unit outside the liquid ejection head may be referred to as an external conductivity measuring unit. In the configuration of the present embodiment, the electrode pair 141A and the 141B that touch the liquid in the liquid chamber is provided separately from the upper electrode 131 and the counter electrode 132 of the cleaning unit 130. The wiring layer that becomes a part of the wiring path 145 included in the liquid ejection head, and the switch 144 included in some cases become an internal conductivity measuring unit in the liquid ejection head of the present embodiment.

To measure conductivity of the liquid, there is also a method for measuring a value of a current flowing between the upper electrode 131 and the counter electrode 132. However, kogation adheres to the surface of the thermal action portion 108 of the upper electrode 131, and an area that acts as the electrode becomes unstable due to a degree of adhesion of kogation. Therefore, the measurement value may be changed easily. To correctly know conductivity of the liquid, as illustrated, it is desirable to provide, separately from the upper electrode 131, another electrode to which kogation does not adhere. If there is no problem when the upper electrode 131 and the counter electrode 132 are used as an electrode pair for conductivity measurement, the wiring path 135 functions also as the wiring path 145 of the present embodiment. That is, the liquid ejection head disclosed in Japanese Patent Laid-Open No. 2008-105364 may be used as the method for cleaning of the present invention.

Since no kogation adheres to the counter electrode 132, the counter electrode 132 may be used also as a part of the conductivity measuring unit. That is, the counter electrode 132 may also be used as one of the electrode of the electrode pair 141A and 141B for conductivity measurement. In this case, since the other electrode of the electrode pair is included independent of the upper electrode 131 and the counter electrode 132, the liquid ejection head becomes the liquid ejection head having the conductivity measuring unit in the present invention. In a case in which a plurality of counter electrodes 132 exist in one liquid chamber, two closely located counter electrodes 132 may be used as the electrode pair 141A and 141B for measuring conductivity. In that case, a part of the wiring path 135 functions also as the wiring path 145, and switches the circuits inside or outside of the liquid ejection head. If switching of the circuits is possible inside of the liquid ejection head, that liquid ejection head becomes the liquid ejection head having the conductivity measuring unit in the present invention. Thus, that the liquid ejection head has the conductivity measuring unit in the present invention means the present invention has a member and a circuit provided for measuring conductivity that are not provided in publicly known liquid ejection heads.

Figure 2:
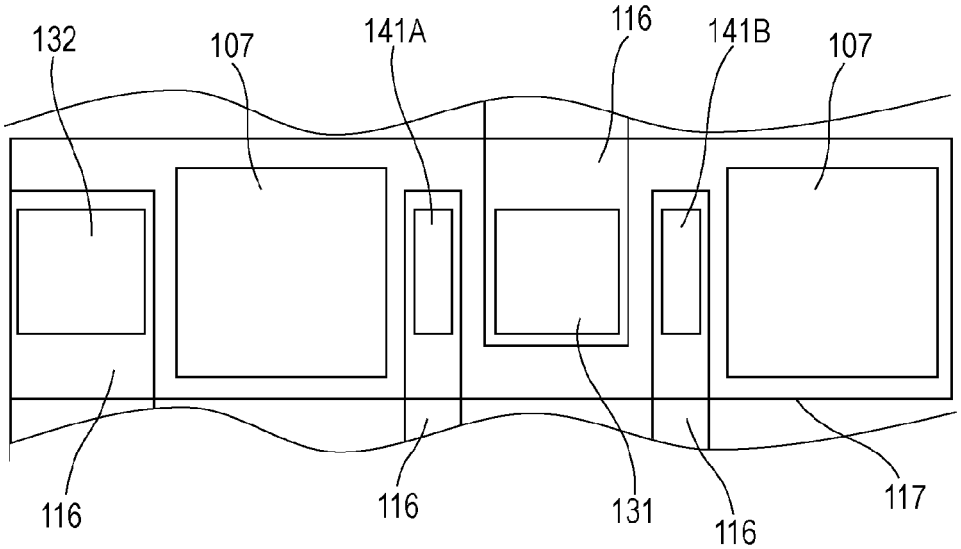
FIG. 2 is a schematic plan view of a liquid ejection head according to an embodiment of the present invention.
Figure 3:
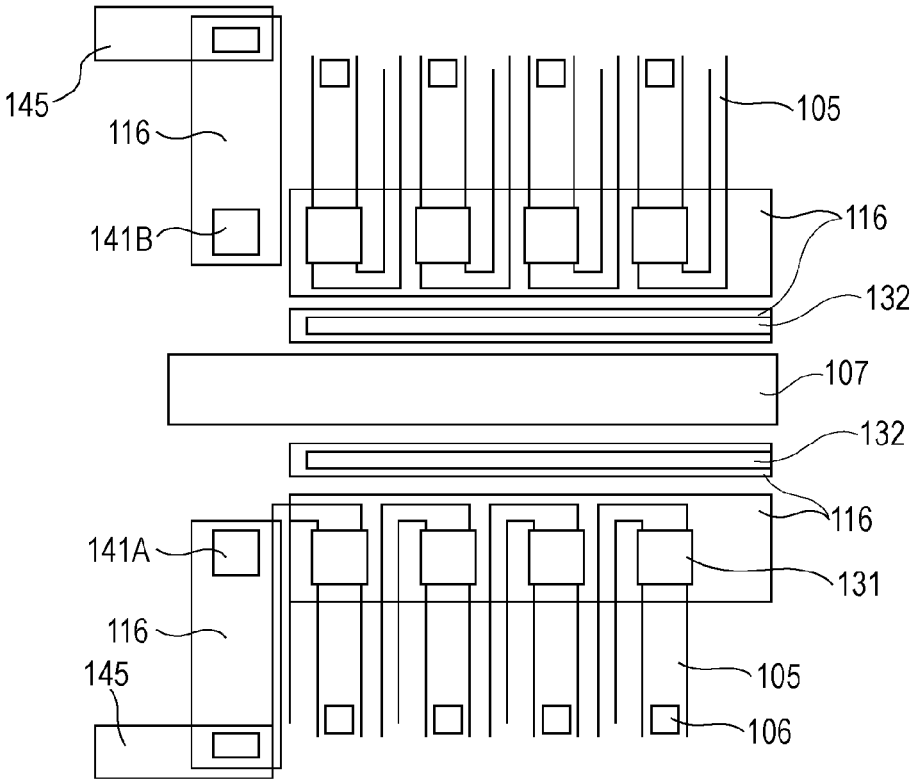
FIG. 3 is a schematic plan view of a liquid ejection head according to another embodiment of the present invention.

The electrode pair 141A and 141B may be disposed anywhere as long as they are in the same liquid chamber as that of the upper electrode 131. Desirably, the electrode pair 141A and 141B is disposed close to the upper electrode 131 that removes kogation and, as illustrated in FIG. 2, the electrodes of the electrode pair 141A and 141B may also be disposed on both sides of the upper electrode 131. If disposing the electrode pair 141A and 141B as illustrated in FIG. 2 is difficult by the restrictions on the layout, the electrode pair 141A and 141B for conductivity measurement may also be provided outside in the arranging direction of a plurality of liquid ejection ports 121 communicating with a single liquid chamber as illustrated in FIG. 3.

The configuration described above is referred to as the liquid ejection head substrate 100. In the liquid ejection head substrate 100, a liquid supply port 107 for introducing the liquid in the liquid chamber 117 from an unillustrated liquid container portion (e.g., an ink reservoir) is provided to penetrate the liquid ejection head substrate 100. On the liquid ejection head substrate 100, the liquid ejection ports 121 are formed at positions corresponding to the thermal action portions 108, and a flow path forming member 120 for forming the liquid chamber (i.e., a liquid flow channel) 117 that becomes a flow path communicating with the liquid ejection ports 121 via the thermal action portions 108 from the liquid supply port 107 is formed. The liquid ejection head 1 is thus formed.

Figure 4:
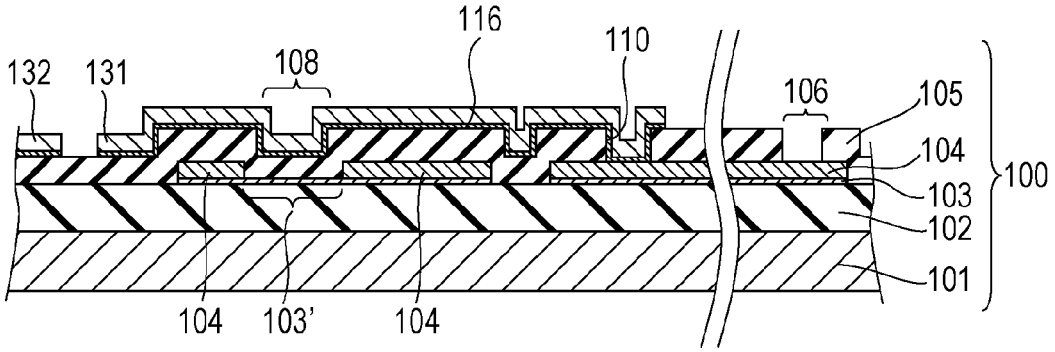
FIG. 4 is a schematic cross-sectional view of a liquid ejection head substrate according to an embodiment of the present invention.

As illustrated in FIG. 4, a heat generating resistive element layer 103 is provided on the liquid ejection head substrate 100 via the heat accumulation layer 102 that is formed by an insulating material, such as $SiO_2$ and SiN, on a substrate 101, such as silicon. The heat generating resistive element layer 103 is made of a publicly known material, such as TaSiN. On the heat generating resistive element layer 103, a wiring layer 104 as a wire made of a metallic material, such as Al, Al—Si, and Al—Cu, is provided. A portion of the heat generating resistive element layer 103 exposed through a gap formed by removing a part of the wiring layer 104 becomes the electrothermal converting portion 103'. An insulating protective layer 105 made of an insulating material, such as $SiO_2$ and SiN, for insulating the electrothermal converting portion 103' from the liquid in the liquid chamber 117 is provided on the wiring layer 104. The adhesion layer 116 is provided on the protective layer 105. A circumference of the electrothermal converting portion 103' including the protective layer 105 may be referred to as the heat generating portion. A part of the adhesion layer 116 is connected to the wiring layer 104 that is separated electrically from the electrothermal converting portion 103' via the through hole 110 provided in the protective layer 105. On the protective layer 105, the upper electrode 131, the counter electrode 132, and the electrode pair 141A and 141B are provided via the adhesion layer 116. The wiring layer 104 electrically connected with these components becomes a part of the wiring paths 135 and 145 illustrated in FIG. 1. The wiring layer 104 is connected to an external circuit provided inside a recording apparatus described later via a terminal section 106 provided in a substrate end. In the present embodiment, among the wire formed by laminating the heat generating resistive element layer 103 and the wiring layer 104 provided under the protective layer 105, the wire that provides a gap in the wiring layer 104 and becomes the electrothermal converting portion 103' and the wire electrically separated from the electrothermal converting portion 103' and becomes a part of the wiring paths 135 and 145 exist.

The adhesion layer 116 is a layer that improves adhesiveness among the upper electrode 131, the counter electrode 132, the electrode pair 141A and 141B, and the protective layer 105, and becomes a part of the wiring paths 135 and 145 by using a conductive material. The adhesion layer 116 is desirably made of a material having enough thermal conductivity to transmit heat generated in the electrothermal converting portion 103' without heat loss to the thermal action portions 108 that touch the liquid. The adhesion layer 116 may be made of any materials having these characteristics, but desirably is made of a liquid resistance material when the adhesion layer 116 partially touches the liquid in the liquid chamber 117. Further, a material that is less easily eluted than the upper electrode 131 at the voltage at which the upper electrode 131 is eluted by the electrochemical reaction during cleaning, i.e., a metallic material, such as valve metal that forms a passive film on its surface, e.g., tantalum and niobium, may be used preferably.

In addition to its original function to elute into the liquid by an electrochemical reaction to remove kogation, the upper electrode 131 also has a function as an upper protective layer that protects the electrothermal converting portion 103' from physicochemical impacts. Further, the upper electrode 131 is also required to have favorable thermal conductivity as the thermal action portions 108 that transmit the heat generated in the electrothermal converting portion 103' to the liquid. Existence of elution of metal by an electrochemical reaction may be known generally from a potential-pH diagram of various types of metal. The upper electrode 131 may be desirably made of a material that has a desirable elution area and does not form a firm oxide film when heated to about 700 degrees centigrade. Such a material may be, desirably, Ir, Ru, an alloy of Ir and other metal, or an alloy of Ru and other metal. Regarding the function as removal of kogation, the greater the content of Ir or Ru becomes, the higher the efficiency in the electrochemical reaction becomes. Therefore, Ir or Ru is the most desirable. However, Ir alloy or Ru alloy may also provide the effect of the present invention. As described above, materials at least including Ir or Ru may provide the effect of the present invention.

The counter electrode 132 and the electrode pair 141A and 141B touch the liquid in the liquid chamber 117 as well as the upper electrode 131. Therefore, the counter electrode 132 and the electrode pair 141A and 141B may be made of any materials that are electrically stable even when in contact with a liquid. For example, the same metallic material as that of the upper electrode 131 may be used. If the same metallic material as that of the upper electrode 131 is used, the counter electrode 132 and the electrode pair 141A and 141B may be formed simultaneously with the upper electrode 131. If the electrode pair 141A and 141B is made of a material that is less elutable than that of the upper electrode 131 at the same potential as the potential at which elution is performed by an electrochemical reaction of the upper electrode 131 at the time of cleaning, it is possible to set the voltage at the time of conductivity measurement close to the voltage at the time of cleaning operation. Such a material may be a material that includes metal that is not substantially eluted by an electrochemical reaction at the potential by forming a passive state.

Figure 5:
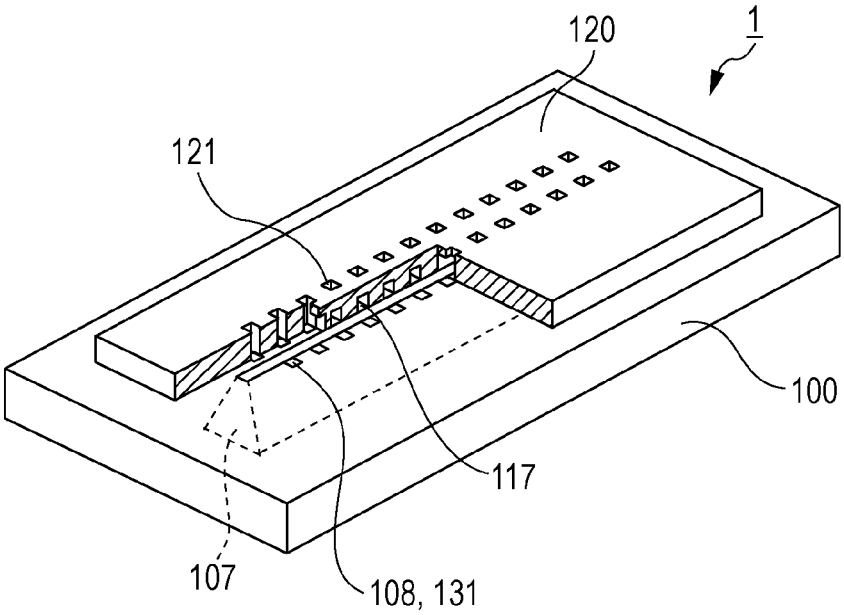
FIG. 5 is a schematic perspective view of a liquid ejection head according to an embodiment of the present invention.

FIG. 5 illustrates a partially exploded perspective view of the liquid ejection head 1 as an embodiment of the present invention. The liquid ejection head 1 has the liquid ejection head substrate 100 on which two element arrays are arranged on both sides of the supply port 107 in which the thermal action portions 108 (i.e., the upper electrodes 131) are formed at predetermined pitches. The liquid ejection head 1 may employ the wiring layout as illustrated in FIG. 3. The liquid ejection head 1 of the present invention is not limited to the example illustrated in FIG. 5, but may be a head that supports multiple colors: for example, a head in which ejection port arrays as illustrated in FIG. 5 are arranged in parallel, and a head in which ejection port arrays are arranged in series.

2. Measurement of Liquid Conductivity and Setting of Cleaning Conditions

The conductivity measurement of the liquid and setting of cleaning conditions that are features of the present invention are described in detail with reference to FIG. 6.

Figure 6:
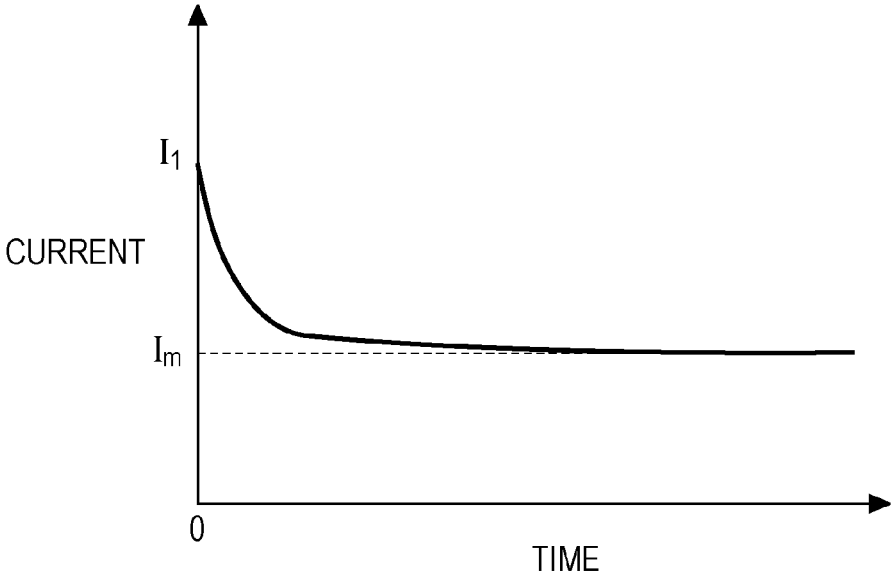
FIG. 6 is a timing chart illustrating a temporal relationship of a detection current flowing in ink of the present invention.

FIG. 6 illustrates a current value detected when a predetermined voltage for conductivity measurement is applied between the electrode pair 141A and 141B. To cause the current flow between the electrode pair 141A and 141B in the liquid, a measurement voltage $V_m$ is applied from the power supply 142 illustrated in FIG. 1. Regarding the current detected by the detection apparatus 143, after the peak value $I_1$ is detected, the current is gradually lowered and is stabilized at a value $I_m$. If the electrode pair 141A and 141B is made of the same material as that of the upper electrode 131, the measurement voltage $V_m$ applied here is a voltage at which the electrode material is not eluted into the liquid by the electrochemical reaction or, even if eluted, an elution amount of each time of the upper electrode 131 is smaller than the elution amount of each time of the upper electrode 131.

Next, conductivity $\sigma_m$ of the liquid is calculated from $I_m$ detected by the detection apparatus 143. Here, a distance between the electrodes of the electrode pair 141A and 141B and the electrode area are constant, and $I_m$ is in proportion to the conductivity $\sigma_m$.

Here, if an electricity amount with which a sufficient elution amount of the upper electrode for one event of removal of kogation is set to $Q_k$, the following Expression (1) is satisfied among the current value $I_k$ at the time of removal of kogation, time $T_k$ during which the voltage for removal of kogation is applied, and the voltage value $V_k$ at the time of removal of kogation:

$$Q_k = I_k T_k = V_k \times \sigma_m \times T_k \times C \quad (1).$$

In Expression (1), C is a constant that depends on the distance between the upper electrode 131 and the counter electrode 132, and the electrode area. To set the elution amount of the upper electrode 131 to be constant, that is, to set $Q_k$ to be constant, if, for example, conductivity $\sigma_m$ becomes twice, it is only necessary to set the voltage value $V_k$ at the time of removal of kogation to ½, to set application time $T_k$ to ½, or to set $V_k \times T_k$ to ½.

In the present embodiment, the measured value of conductivity $\sigma_m$ is fed back to the setting of the voltage value $V_k$ applied to the upper electrode 131 and/or the application time $T_k$ for the removal of kogation. In this manner, the electricity amount applied to the upper electrode 131 during each removal of kogation event may be set to be constant even if conductivity of the liquid is changed, and cleaning may be performed with a constant elution amount.

3. Description of Cleaning Operation (Removal of Kogation)

The removal of kogation operation of the present invention uses the electrochemical reaction with a liquid (ink) which is an electrolyte solution. In the present invention, the upper electrode 131 is used as an anode electrode and the counter electrode 132 is used as a cathode electrode. By causing the upper electrode 131 that is an anode electrode to be eluted, deposited kogation may be removed as the upper electrode 131 is eluted. As disclosed in Japanese Patent Laid-Open No. 2008-105364, if the polarities of the upper electrode 131 and the counter electrode 132 are inverted during the removal of kogation operation, it is possible to re-release the components in the liquid that have been absorbed or attracted to the electrode surface during the removal of kogation operation.

4. Description of Recording Apparatus

Figure 7:
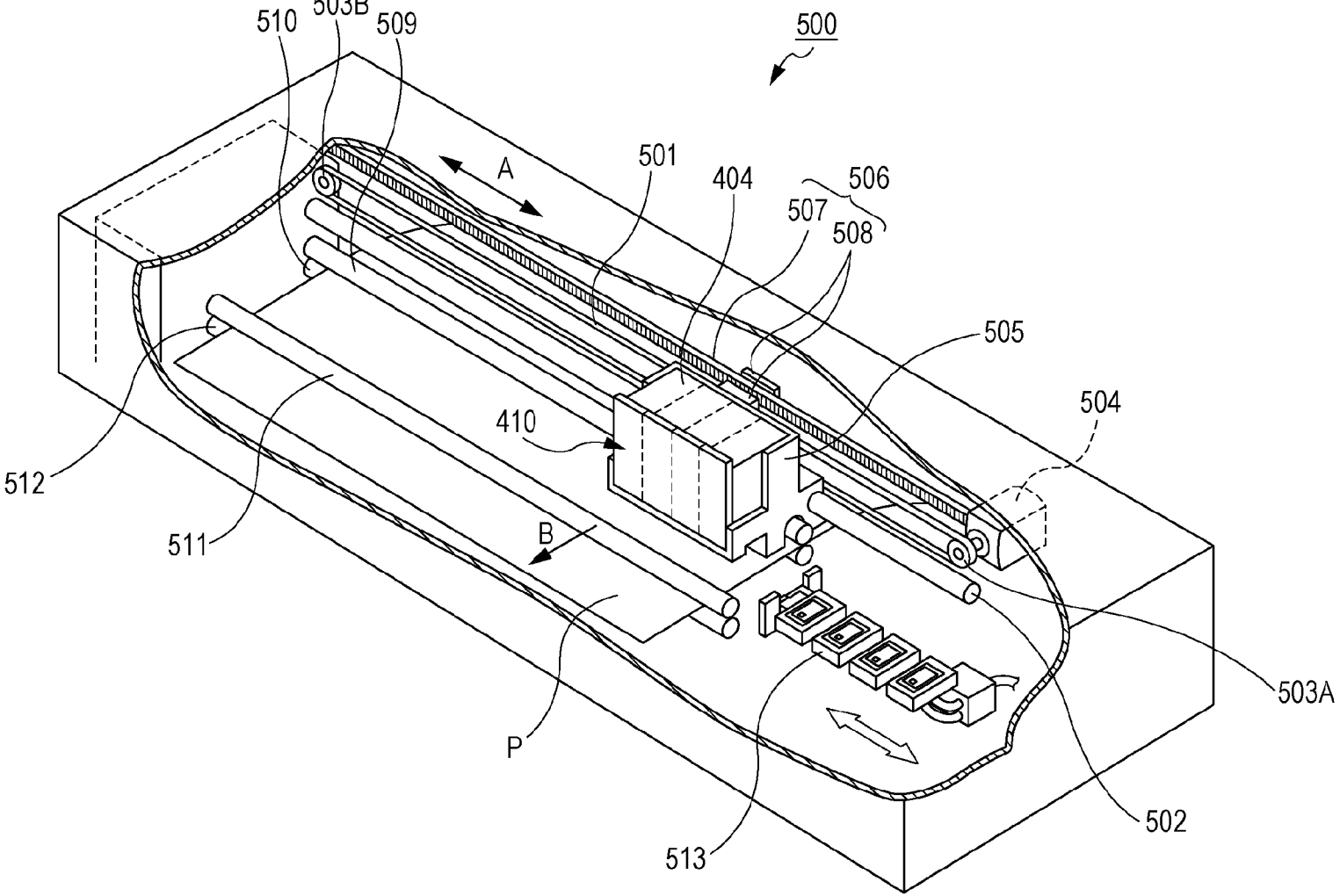
FIG. 7 is a perspective view illustrating an exemplary configuration of a recording apparatus that includes, as a component, a liquid ejection head according to an embodiment of the present invention.

FIG. 7 illustrates an example of a schematic structure of a recording apparatus 500 according to the present embodiment.

In the illustrated recording apparatus 500, a carriage 505 is fixed to an endless belt 501, and is movable along a guide shaft 502. The endless belt 501 is wound around pulleys 503A and 503B, and a drive shaft of a carriage driving motor 504 is connected to the pulley 503A. Thus, the carriage 505 is subject to main scanning in a reciprocal direction (i.e., a direction A) along the guide shaft 502 when driven to rotate by the motor 504.

Figure 8:
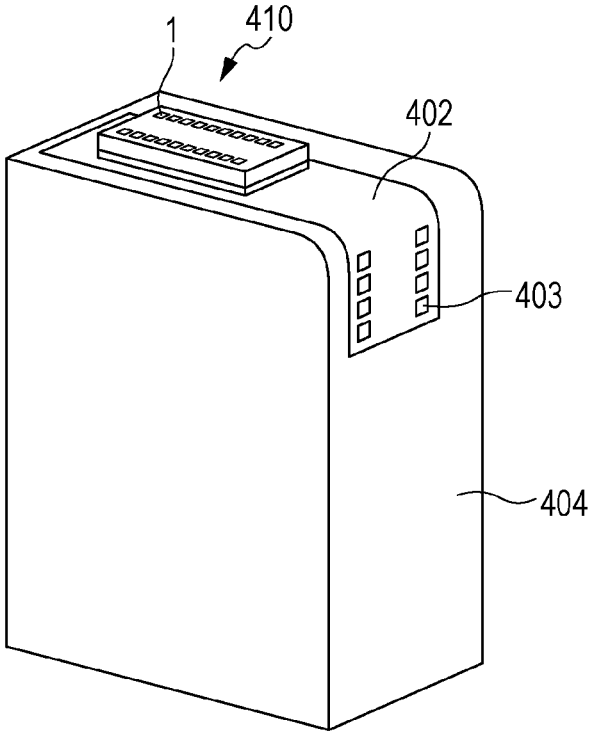
FIG. 8 is a perspective view illustrating an exemplary configuration of a head unit that includes, as a component, a liquid ejection head according to an embodiment of the present invention.

A head unit 410 in a form of a cartridge is mounted on the carriage 505. Here, the head unit 410 is mounted on the carriage 505 so that the ejection ports 121 of the liquid ejection head 1 face a paper sheet P as the recording medium, and the arranging direction of the ejection ports 121 coincides with a direction different from the main scanning direction (the direction A) (for example, a sub-scanning direction that is a conveyance direction of the paper sheet P (a direction B)). The head unit 410 may have, for example, an exemplary configuration illustrated in FIG. 8. In FIG. 8, the reference numeral 402 denotes a tape member for tape automated bonding (TAB) having a terminal for supplying electric power to the liquid ejection head 1. The tape member 402 may exchange electric power and various signals to and from the recording apparatus main body via a contact point 403. The reference numeral 404 is a reservoir for supplying a liquid (ink) to the liquid ejection head 1. That is, the head unit 410 in FIG. 8 has a form of a cartridge attachable to the recording apparatus 500 of FIG. 7. The head unit 410 may be a non-reservoir integrated type in which the liquid ejection head 1 and the reservoir 404 are provided separately. The liquid ejection head 1 may support a plurality of colors. The reservoir 404 may be disposed at a place other than the carriage 505, and the liquid may be supplied using, for example, a tube to the liquid ejection head 1 provided in the carriage 505. The numbers of pairs of the liquid ejection head 1 and the reservoir 404 may correspond to the numbers of the ink colors to be used: in the example illustrated in FIG. 7, four pairs are provided corresponding to four colors (e.g., black, yellow, magenta, and cyan).

A linear encoder 506 is provided in the recording apparatus 500 of FIG. 7 for the purpose of, for example, detecting a moved position of the carriage 505 in the main scanning direction. One component of the linear encoder 506 is a linear scale 507 provided along a direction in which the carriage 505 is moved. Slits are formed in the linear scale 507 at predetermined densities and at regular intervals. The carriage 505 is provided with, as another component of the linear encoder 506, for example, a detection system 508 including a light emitting unit and a light receiving sensor, and a signal processing circuit. Therefore, the linear encoder 506 outputs ejection timing signals for determining ink ejection timing and position information about the carriage as the carriage 505 moves.

A recording sheet P as the recording medium is conveyed intermittently in the direction of arrow B that crosses perpendicularly the scanning direction of the carriage 505. The recording sheet P is supported by a pair of roller units 509 and 510 on the upstream side in the conveying direction and a pair of roller units 511 and 512 on the downstream side, and is conveyed under constant tension so that the recording sheet P is kept smooth with respect to the liquid ejection head 1. Driving force to each roller unit is transmitted from an unillustrated conveyance motor.

With the configuration described above, recording on the entire recording sheet P is performed by alternately repeating the recording corresponding to the arrangement width of the ejection ports 121 of the liquid ejection head 1 as the carriage 505 is moved and conveying the recording sheet P.

The carriage 505 stops at a home position as needed when recording is started or during recording. At the home position, cap members 513 are provided for covering a surface of the liquid ejection head 1 on which the ejection ports 121 are provided (i.e., an ejection port surface). A mechanism (not illustrated) that generates negative pressure in the cap, and sucks the ink from the ejection port 121 to compulsorily discharge the liquid in the liquid chamber 117 is connected to each of the cap members 513. The mechanism that sucks and discharges the liquid is generally referred to as a suction recovery mechanism, and the liquid discharging operation performed by the mechanism is referred to as a suction recovery operation. Clogging, for example, of the ejection ports 121, is prevented by the suction recovery operation.

Figure 9:
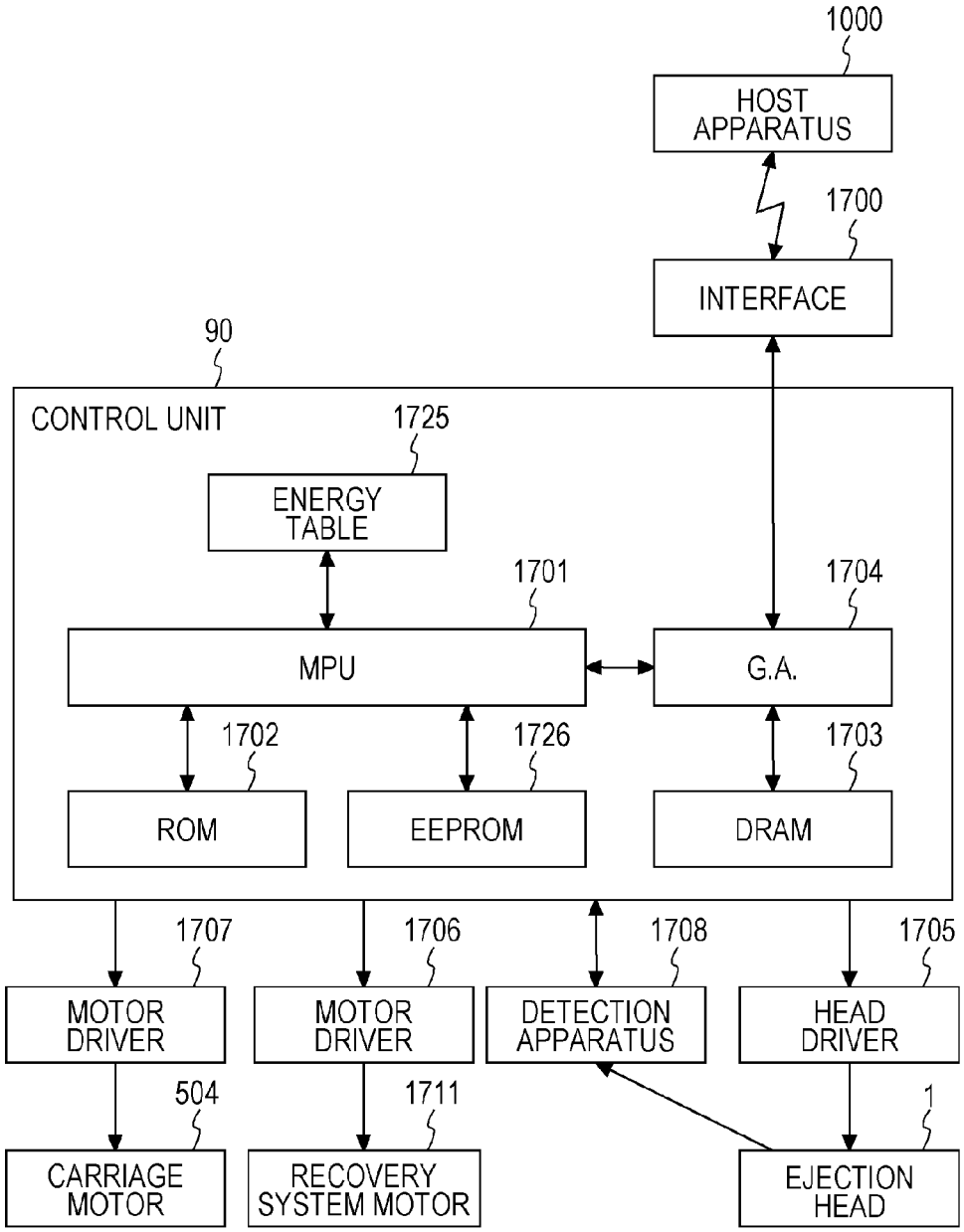
FIG. 9 is a block diagram illustrating an exemplary configuration of a control system of the recording apparatus of FIG. 7.

FIG. 9 is a block diagram illustrating an exemplary configuration of a control system in the recording apparatus 500 of the configuration described above.

In FIG. 9, the reference numeral 1700 denotes an interface that receives record signals including commands and image data sent from a host apparatus 1000 in a suitable form of, for example, a computer, a digital camera, and a scanner. Status information of the recording apparatus 500 is sent to the host apparatus 1000 if necessary. In the control unit 90, an MPU 1701, a ROM 1702, a DRAM 1703, a gate array (G.A.) 1704, an energy table 1725, and non-volatile memory 1726, such as EEPROM, are included. The MPU 1701 controls each part of the recording apparatus 500 in accordance with a control program and necessary data corresponding to a cleaning process and an energy setting procedure stored in the ROM 1702 described later with reference to FIG. 10. Data stored in the ROM 1702 include the shape and application time of a driving pulse applied to the electrothermal converting portion 103' and steady driving conditions of the liquid ejection head 1, such as a voltage applied between the electrode pair 141A and 141B. Further, conveyance conditions of the recording medium, carriage speed, and other conditions may also be included.

The DRAM 1703 stores various data (e.g., the recording signals or recording data supplied to the head). An area for, for example, flags used in a control process described later may be provided in the DRAM 1703. The gate array 1704 performs supply control of the recording data to the liquid ejection head 1, and data transfer control among the interface 1700, the MPU 1701, and the DRAM 1703. The energy table 1725 stores data used for determination of energy necessary to eject ink, such as a pulse width of an ejection signal. The non-volatile memory 1726 stores necessary data also when the power of the recording apparatus 500 is turned off.

The reference numeral 504 denotes a carriage driving motor illustrated in FIG. 7. The reference numeral 1711 denotes a recovery system motor used as a drive source in a covering operation of cap member 513 illustrated in FIG. 7 and in an operation of the suction recovery unit, such as a pump that performs the suction recovery. The reference numeral 1706 denotes a motor driver that drives the carriage driving motor 504, and 1707 denotes a motor driver that drives the recovery system motor 1711. The reference numeral 1705 denotes a head driver that drives the liquid ejection head 1, and performs the cleaning operation and an ejection energy setting operation. The reference numeral 1708 denotes a detection apparatus that detects a value of a current flowing in the upper electrode 131 and the counter electrode 132 via the liquid (ink). With this detection, the control unit 90 may detect whether ink has been ejected. As described later, the detection apparatus 1708 calculates conductivity of the liquid (ink) by detecting the current value with respect to the voltage applied to the electrode pair 141A and 141B, and feeding the detected current value back to the control unit 90. An external cleaning unit and an external conductivity measuring unit illustrated in FIG. 1 are included in these control systems, and may be partially shared.

5. Description of Cleaning Sequence

Figure 10:
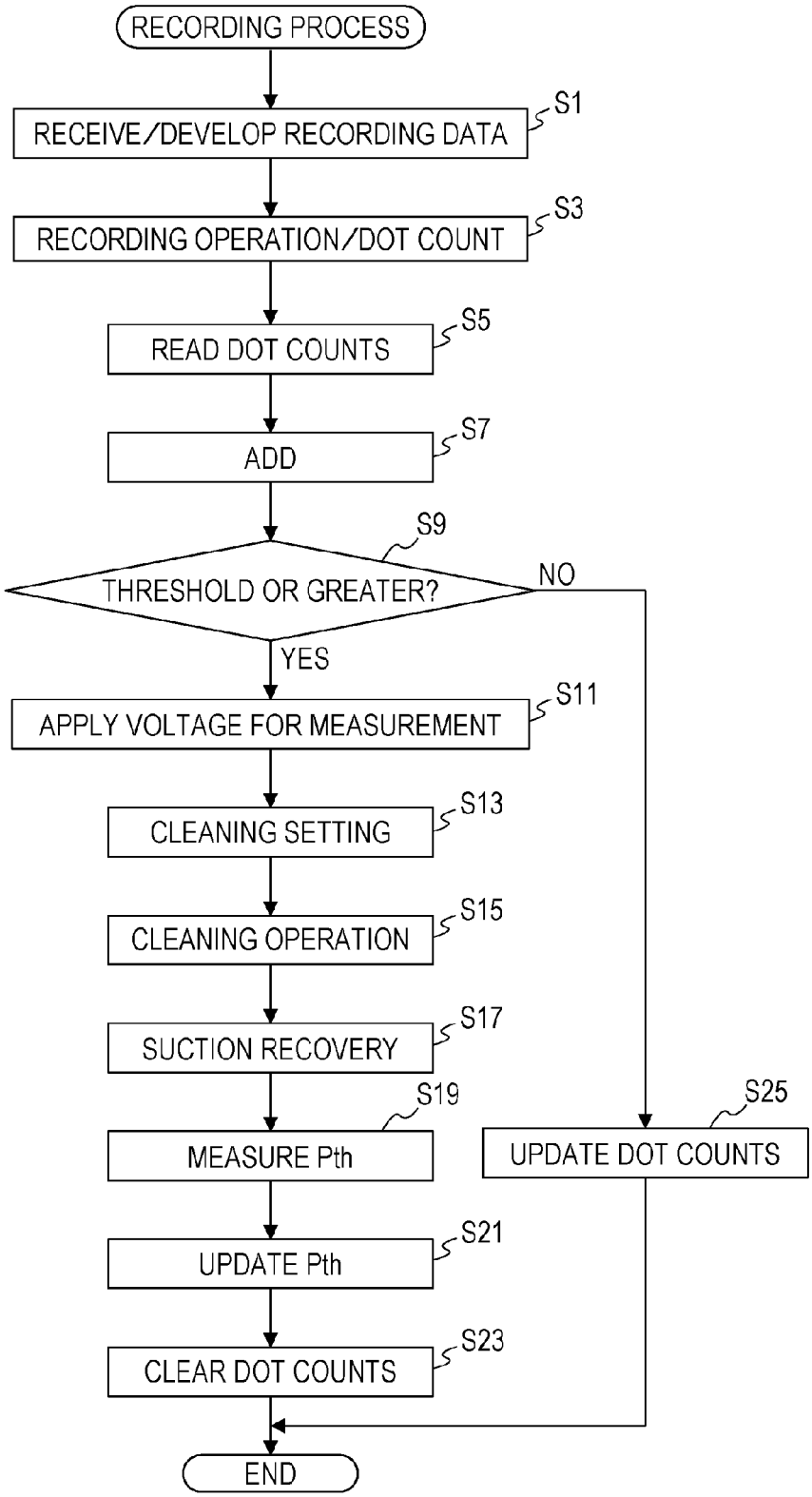
FIG. 10 is a flowchart illustrating an exemplary cleaning operation procedure performed by a recording apparatus according to an embodiment of the present invention.

FIG. 10 illustrates an example of a cleaning procedure performable by the recording apparatus 500 that uses the liquid ejection head 1 of the present invention.

When a recording instruction is issued by, for example, the host apparatus 1000, the procedure is started. First, image data related to recording is received from the host apparatus 1000, and the received image data is developed as data suitable for the recording apparatus 500 (step S1). In accordance with the developed recording data, the recording operation by the liquid ejection head 1 is executed while alternately repeating conveyance of the recording sheet P and main-scanning of the carriage 505 (step S3). At this time, the number of recording dots (i.e., the number of driving pulses of the electrothermal converting portion 103') is counted.

When a recording operation of one unit (for example, recording on a recording sheet) is completed, cumulative data of a dot count value stored in the non-volatile memory 1726 is read (step S5), and the number of dots counted this time is added (step S7). Next, whether the addition value is equal to or greater than a predetermined value Th (e.g., $1\times10^7$) (Yes) or not (No) is determined (step S9).

If the determination result is affirmative (Yes), a voltage for conductivity measurement is applied to the electrode pair 141A and 141B in the conductivity measuring unit 140 illustrated in FIG. 1 (step S11). By detecting the current value against the voltage applied in step S11, conductivity of the liquid is calculated, and the cleaning conditions are set in accordance with the detected value (step S13).

As described above, in the cleaning unit 130 illustrated in FIG. 1, the cleaning operation is performed with a voltage being applied so that the upper electrode 131 becomes the anode side in the electrochemical reaction (step S15). In the cleaning operation, kogation on the thermal action portions 108 is removed as the surface of the upper electrode 131 is eluted by the electrochemical reaction. After the cleaning operation is performed, the liquid (ink) including the eluted formation material of the upper electrode 131 and removed kogation stays near the ejection ports 121. If this ink does not affect recording quality, it is possible to eject the ink from the ejection ports 121 for the next recording operation. However, in the present embodiment, by performing, for example, suction recovery (step S17), the ink is discharged compulsory. During the cleaning operation, the surface of the upper electrode 131 is eluted, and the thickness of the upper electrode 131 of the thermal action portion 108 is reduced. To keep recording quality high, therefore, a threshold (Pth) of the pulse width necessary for foaming is measured again and stored (steps S19, S21). Then, the cumulative data of the dot count value stored in the non-volatile memory 1726 is reset (step S23), and a series of recording process is completed.

If the determination result is negative (No) in step S9, the cumulative data of the dot count value stored in the non-volatile memory 1726 is updated with the addition value (step S25), and the recording process is completed.

Removal of kogation or recovery is performed after the recording operation in the above procedure, but removal of kogation or recovery may be performed before the recording operation. In this case, dot counting is performed in accordance with the recording data developed in step S1, the developed recording data is added to the cumulative value of the dot count, and whether removal of kogation should be performed is determined in accordance with the addition value. Removal of kogation may be performed every after a predetermined amount of recording operation (for example, each or several scanning events of the liquid ejection head). Recovery may be performed before the conductivity measurement. If a single cap member is used for the suction recovery process in a head that supports multiple colors, color mixing of ink may occur and conductivity of ink may change significantly. In the present invention, since the cleaning operation is performed after conductivity is measured, a stable cleaning operation may be performed.

The process for discharging liquid after the removal of kogation is not limited to the suction recovery as described above. The ink may be discharged by pressurizing an ink supply system that reaches the ejection ports. Alternatively, the ink may be discharged by a process to drive the electrothermal converting portion 103' separately from the recording operation (i.e., an auxiliary ejection process). In this case, the driving pulse for auxiliary ejection may also be included in the count.

Thus, in the method for cleaning of the present invention, a plurality of times of cleaning operation are performed until the thickness of the upper electrode 131 is reduced to a predetermined thickness. Conductivity of the liquid is measured before each cleaning operation and, in accordance with the measured conductivity, cleaning conditions are set so that the elution amount of the upper electrode of each time is set to be constant. The final residual film of the upper electrode 131 needs to have a thickness with which the ejection state can be examined and the function as the protective layer against cavitation can be provided: the thickness is preferably equal to or greater than 5 nm, and more preferably equal to or greater than 10 nm. After the final cleaning operation, it is determined that the life of the liquid ejection head has come to end when the determination result is affirmative (Yes) in step S9, and no more conductivity measurement and cleaning operation are performed.

Anyway, according to the present invention, the cleaning process including removal of kogation in a series of recording process may be performed while the head is mounted on the recording apparatus. Therefore, a special and complicated cleaning process performed after removing the liquid ejection head is unnecessary, and a cleaning process may be performed efficiently and stably until the liquid ejection head reaches its end of life.

EXAMPLES

Hereinafter, the present invention is described in detail with reference to Examples, but the present invention is not limited thereto.

Example 1

As a liquid ejection head of Example 1, in the same manner as that of the method disclosed in Japanese Patent Laid-Open No. 2008-105364, as illustrated in FIG. 2 (or FIG. 3), an $SiO_2$ heat accumulation layer, a TaSiN heat generating resistive element layer 103, an Al wiring layer 104, and an SiN protective layer 105 are formed in this order on an Si substrate 101. The electrothermal converting portion 103' is formed by etching a part of the Al wiring layer 104. After forming 100 nm of tantalum as the adhesion layer 116 on the protective layer 105, 50 nm of an iridium film is formed. The iridium film is patterned to form the upper electrode 131, the counter electrode 132, and the electrode pair 141A and 141B. Then, in the same manner as disclosed in Japanese Patent Laid-Open No. 2008-105364, the ink supply port 107 is formed, the flow path forming member 120 is formed, other necessary terminal portions are formed, and the like. The liquid ejection head is thus completed. The head unit of Example 1 is not an ink reservoir integrated type as illustrated in FIG. 8 but an ink reservoir non-integrated type.

Experiment of Removal of Kogation

An experiment of removal of kogation is conducted using the liquid ejection head described above.

Dye magenta ink is used. First, a new ink reservoir is placed in the liquid ejection head and the electrothermal converting portion 103' is driven under predetermined conditions so that kogation is deposited on the thermal action portion 108. When a surface state is observed, impurities called kogation K is deposited substantially uniformly on the thermal action portion 108. When recording is performed using the liquid ejection head in this state, it is examined that recording quality is reduced by the deposition of the kogation K. Substantially, a DC voltage of 1V is applied to the electrode pair 141A and 141B, and conductivity of the liquid is measured. Cleaning conditions are set in accordance with the value of conductivity and cleaning is performed. After the cleaning is performed, printing quality is examined.

The series of "placing a new ink reservoir, driving to deposit kogation, measuring conductivity, determining cleaning conditions, cleaning, and examining printing quality" is referred to as one sequence, and five cycles of the sequence are performed.

Measurement results of conductivity, cleaning conditions determined in accordance with the measured conductivity, and printing quality after cleaning in each cycle are shown in Table 1.

Criteria of the printing quality are as follows:

A: substantially equal to the initial quality.

B: lowered from the initial quality.

TABLE 1

| | CONDUCTIVITY MEASUREMENT RESULT | CLEANING CONDITIONS | PRINTING QUALITY |
|---|---|---|---|
| FIRST CYCLE | 2000 μS/cm | 10 V, 10 sec | A |
| SECOND CYCLE | 2100 μS/cm | 10 V, 10 sec | A |
| THIRD CYCLE | 1900 μS/cm | 10 V, 11 sec | A |
| FOURTH CYCLE | 1650 μS/cm | 10 V, 12 sec | A |
| FIFTH CYCLE | 1900 μS/cm | 10 V, 11 sec | A |

When a surface state of the thermal action portion 108 is observed after the sequence in each cycle is completed, it is examined that the deposited kogation K has been removed. When recording is performed after the ink reservoir is replaced, recording quality is recovered to the substantially initial quality. In Example 1, when the thickness of the residual film of the upper electrode 131 after the sequence of the fifth cycle is completed is examined, the thickness is about 40 nm, which is substantially as much as expected.

Example 2

A liquid ejection head that supports a plurality of colors is manufactured in the same manner as in Example 1. Using this liquid ejection head, an experiment of removal of kogation is conducted. Dye magenta ink is used in a nozzle array that performs ejection and removal of kogation, and dye cyan ink is used in a nozzle array adjacent to the above nozzle array. Each of the electrodes for conductivity measurement in Example 2 is disposed between the upper electrode 131 above the heat generating portion and the liquid supply port 107 as illustrated in FIG. 2.

First, magenta ink is used and the electrothermal converting portion 103' is driven under predetermined conditions so that kogation K is deposited on the surface of the thermal action portion 108. When a surface state is observed, kogation K is deposited substantially uniformly on the surface of the thermal action portion 108. When recording is performed using the liquid ejection head in this state, it is examined that recording quality is reduced by the deposition of the kogation K.

Then, the ejection nozzle array and the adjacent nozzle array are sucked simultaneously using the same capping member. Substantially, a DC voltage of 1V is applied to the electrode pair 141A and 141B, and conductivity of the liquid is measured. In accordance with the value of conductivity, cleaning conditions are set so that the elution amount of the upper electrode 131 becomes constant and cleaning is performed. After the cleaning is completed, the ink is ejected and printing quality is examined.

The series of "driving to deposit kogation, sucking by the cap, measuring conductivity, determining cleaning conditions, cleaning, and examining printing quality" is referred to as one sequence, and five cycles of the sequence are performed.

Measurement results of conductivity, cleaning conditions determined in accordance with the measured conductivity, and printing quality after cleaning in each cycle are shown in Table 2.

TABLE 2

| | CONDUCTIVITY MEASUREMENT RESULT | CLEANING CONDITIONS | PRINTING QUALITY |
|---|---|---|---|
| FIRST CYCLE | 3100 μS/cm | 9.7 V, 30 sec | A |
| SECOND CYCLE | 3000 μS/cm | 10.0 V, 30 sec | A |
| THIRD CYCLE | 3200 μS/cm | 9.4 V, 30 sec | A |
| FOURTH CYCLE | 3300 μS/cm | 9.1 V, 30 sec | A |
| FIFTH CYCLE | 3200 μS/cm | 9.4 V, 30 sec | A |

Conductivity is changed in each cycle, which is considered to be because of color mixing of ink caused by suction by the same cap.

When the surface of the thermal action portion 108 is observed after the sequence in each cycle is completed, it is examined that the deposited kogation K has been removed. When printing quality is examined, it is recovered to substantially the initial quality. The thickness of the residual film after the cleaning of the fourth cycle is completed is about 10 nm, and ejection check of fifth cycle is possible.

Comparative Example 1

In Comparative Example 1, after replacing with a new ink reservoir in Example 1, cleaning is performed under the same cleaning conditions of 10.0 V and 10 sec in each cycle without measuring conductivity. Other procedures are the same as those of Example 1.

Printing quality after the sequence in each cycle is completed is shown in Table 3.

TABLE 3

| | CONDUCTIVITY MEASUREMENT RESULT | CLEANING CONDITIONS | PRINTING QUALITY |
|---|---|---|---|
| FIRST CYCLE | NONE | 10.0 V, 10 sec | A |
| SECOND CYCLE | NONE | 10.0 V, 10 sec | A |
| THIRD CYCLE | NONE | 10.0 V, 10 sec | B |
| FOURTH CYCLE | NONE | 10.0 V, 10 sec | B |
| FIFTH CYCLE | NONE | 10.0 V, 10 sec | B |

When the surface of the thermal action portion 108 is observed after the sequences in the third, the fourth and the fifth cycles are completed, kogation is not sufficiently removed and printing quality is not recovered to the initial quality.

Comparative Example 2

Comparative Example 2 is the same as Example 2 except that cleaning is performed under the same cleaning conditions of 10.0 V and 30 sec in each cycle without measuring conductivity.

Printing quality after the sequence in each cycle is completed is shown in Table 4.

TABLE 4

| | CONDUCTIVITY MEASUREMENT RESULT | CLEANING CONDITIONS | PRINTING QUALITY |
|---|---|---|---|
| FIRST CYCLE | NONE | 10.0 V, 30 sec | A |
| SECOND CYCLE | NONE | 10.0 V, 30 sec | A |
| THIRD CYCLE | NONE | 10.0 V, 30 sec | A |

TABLE 4-continued

| | CONDUCTIVITY MEASUREMENT RESULT | CLEANING CONDITIONS | PRINTING QUALITY |
|---|---|---|---|
| FOURTH CYCLE | NONE | 10.0 V, 30 sec | A |
| FIFTH CYCLE | STOP BECAUSE WIRE BREAK OCCUR DURING DEPOSITION OF KOGATION | | |

When the surface of the thermal action portion 108 is observed after the sequence in the fourth cycle is completed, the upper electrode 131 is substantially eliminated and the adhesion layer 116 is exposed. The fifth cycle is started in this state. Immediately after ejection for depositing kogation is started, wire break occurs. Neighborhood of the thermal action portion 108 is observed and it is found that the cause of the wire break is cavitation.

From the above results, according to the present invention, since the elution amount of the upper electrode during removal of kogation is controllable to a constant amount, kogation may be removed reliably and favorable ejection characteristics may be maintained.

INDUSTRIAL APPLICABILITY

According to the present invention, appropriate conditions for removal of kogation may be determined and, therefore, the remaining amount of the upper electrode that affects residual life of the liquid ejection head may be calculated reliably. Since kogation is sufficiently removed, the ejection characteristics of the liquid ejection head may be stabilized, and reliable high quality image recording may be performed. Therefore, the industrial applicability of the present invention is very high.

In the above description, the liquid for ejection (i.e., ink) is used, but the present invention is not limited to the same. The present invention is applicable also to, for example, a cleaning liquid at the time of recycling the liquid ejection head.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions. The scope of the following claims is to be accorded the broadest interpretation so as to encompass all such modifications and equivalent structures and functions.

This application claims the benefit of Japanese Patent Application No. 2014-105925, filed May 22, 2014 which is hereby incorporated by reference herein in its entirety.

What is claimed is:

1. A liquid ejection head, comprising:

liquid ejection ports;

a liquid chamber communicating with the liquid ejection ports;

an electrothermal converting portion disposed in the liquid chamber;

an insulating protective layer configured to insulate the electrothermal converting portion from a liquid in the liquid chamber;

an upper electrode configured to cover at least a heat generating portion heated by the electrothermal converting portion of the protective layer, and made of a material eluted by an electrochemical reaction with the liquid; and a counter electrode provided to be electrically connectable with the upper electrode via the liquid, and configured to cause the electrochemical reaction between the upper electrode and the liquid, wherein the liquid ejection head includes a conductivity measuring unit of the liquid provided with an electrode pair that touches the liquid in the liquid chamber, and the one electrode of the electrode pair is the counter electrode, and the other electrode of the electrode pair is an electrode provided separately from the upper electrode and the counter electrode.

2. The liquid ejection head according to claim 1, wherein the electrode of the electrode pair provided separately from the upper electrode and the counter electrode is made of a material with a smaller elution amount than that of the upper electrode at a potential at which the upper electrode is caused to elute by the electrochemical reaction.

3. The liquid ejection head according to claim 1, wherein the electrode pair is made of the same material as that of the upper electrode, and conductivity of the liquid is measured at a potential lower than a potential at which the upper electrode is caused to elute by the electrochemical reaction.

4. The liquid ejection head according to claim 1, wherein the liquid ejection head includes a plurality of liquid ejection ports that communicate with a single liquid chamber, and at least one electrode of the electrode pair is provided at an outer side in an arranging direction of a plurality of the liquid ejection ports.

5. A liquid ejection head, comprising:

liquid election ports;

a liquid chamber communicating with the liquid election ports;

an electrothermal converting portion disposed in the liquid chamber;

an insulating protective layer configured to insulate the electrothermal converting portion from a liquid in the liquid chamber;

an upper electrode configured to cover at least a heat generating portion heated by the electrothermal convertin g portion of the protective layer, and made of a material eluted by an electrochemical reaction with the liquid; and a counter electrode provided to be electrically connectable with the upper electrode via the liquid, and configured to cause the electrochemical reaction between the upper electrode and the liquid, wherein the liquid election head includes a conductivity measuring unit of the liquid provided with an electrode pair that touches the liquid in the liquid chamber, and wherein the electrode pair is disposed near the upper electrode so that the electrodes face each other via the upper electrode.

6. A liquid ejection head, comprising:

liquid election ports;

a liquid chamber communicating with the liquid election ports;

an electrothermal convertin g portion disposed in the liquid chamber;

an insulating protective layer configured to insulate the electrothermal converting portion from a liquid in the liquid chamber;

an upper electrode configured to cover at least a heat generating portion heated by the electrothermal converting portion of the protective layer, and made of a material eluted by an electrochemical reaction with the liquid; and a counter electrode provided to be electrically connectable with the upper electrode via the liquid, and configured to cause the electrochemical reaction between the upper electrode and the liquid, wherein the liquid election head includes a conductivity measuring unit of the liquid provided with an electrode pair that touches the liquid in the liquid chamber, and wherein the upper electrode, the counter electrode, and the electrode pair are disposed on the protective layer via a conductive adhesion layer, and the upper electrode, the counter electrode, and the electrode pair are electrically connected to a wiring path provided below the protective layer via through holes provided independently in the adhesion layer and the protective layer.

7. The liquid ejection head according to claim 6, wherein a wire formed by laminating a heat generating resistive element layer and a wiring layer is provided below the protective layer, the electrothermal converting portion of the wire is formed by providing a gap in the wiring layer, and the wiring path is the wire separated electrically from the electrothermal converting portion.

* * * * *